United States Patent [19]

Balass

[11] 4,387,634

[45] Jun. 14, 1983

[54] DIAPHRAGM PRESS FOR AGRICULTURAL PRODUCTS, SUCH AS GRAPES, FRUITS AND OTHER FRUIT-LIKE PRODUCTS

[75] Inventor: Valentin Balass, Zürich, Switzerland

[73] Assignee: Bucher-Buyer AG, Niederwenigen, Switzerland

[21] Appl. No.: 321,678

[22] Filed: Nov. 16, 1981

[30] Foreign Application Priority Data

Nov. 25, 1980 [CH] Switzerland ..... 8691/80

[51] Int. Cl.[3] ..... B30B 5/02

[52] U.S. Cl. ..... 100/211; 100/116; 100/264

[58] Field of Search ..... 100/107, 108, 110, 116, 100/193, 202, 208, 211, 234, 264, 50; 210/350, 351

[56] References Cited

U.S. PATENT DOCUMENTS

| | | | |
|---|---|---|---|
| 2,538,403 | 1/1951 | Watson | 100/50 |
| 4,106,404 | 8/1978 | Schmid | 100/211 |
| 4,140,051 | 2/1979 | Hauser et al. | 100/211 |
| 4,151,795 | 5/1979 | Huaser | 100/211 |
| 4,214,519 | 7/1980 | Stollenwerk | 100/264 |

FOREIGN PATENT DOCUMENTS

| | | |
|---|---|---|
| 1001589 | 1/1957 | Fed. Rep. of Germany . |
| 2352300 | 4/1975 | Fed. Rep. of Germany . |
| 226437 | 7/1943 | Switzerland . |
| 579979 | 9/1976 | Switzerland . |

*Primary Examiner*—Harvey C. Hornsby
*Assistant Examiner*—Arthur D. Dahlberg
*Attorney, Agent, or Firm*—Werner W. Kleeman

[57] ABSTRACT

A press container of a diaphragm press for agricultural products, such as grapes, fruits and other fruits or fruit-like products is driven to be rotatable about its horizontal lengthwise axis and is provided with two substantially hood-shaped diaphragms or membranes. The diaphragm attachment elements are arranged at surfaces which run with opposite inclination in the direction of the inlet and outlet opening, respectively. During the filling of the container the diaphragms are located at the upper side thereof and at the same time juice outlet channels of the press container lie free at the region of dropping of the mesh. This leads to an increased juice extraction by pre-dejuicing. The conveying action of the diaphragm attachment elements facilitates the removal of the grape or product residue.

7 Claims, 6 Drawing Figures

Fig.1
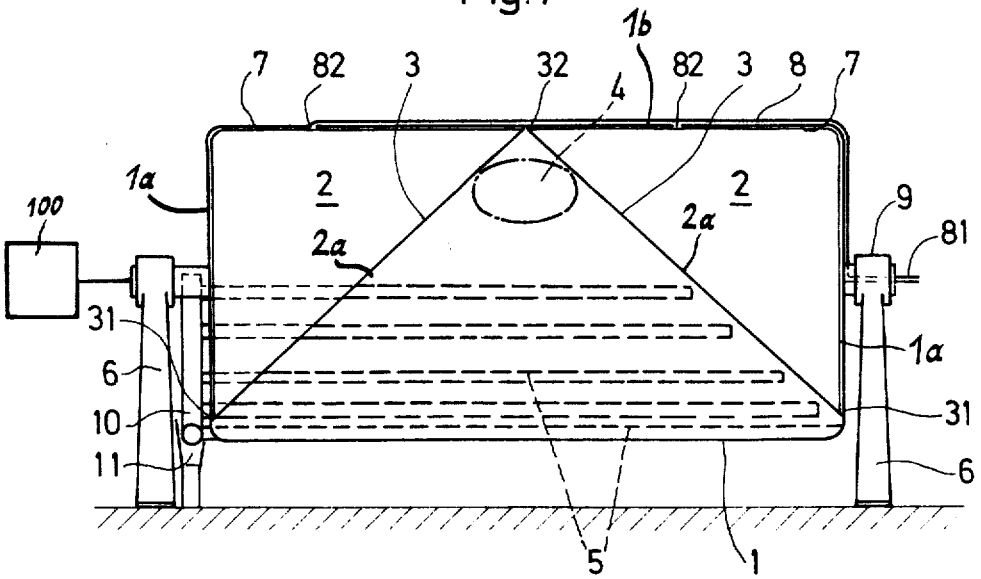
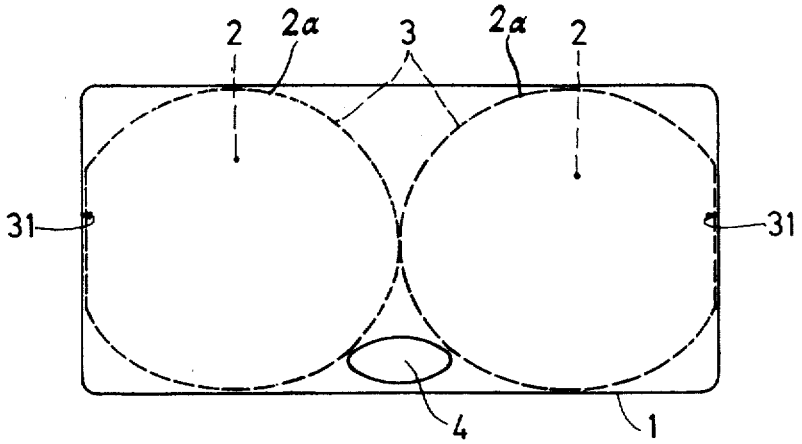
Fig. 2

Fig. 3
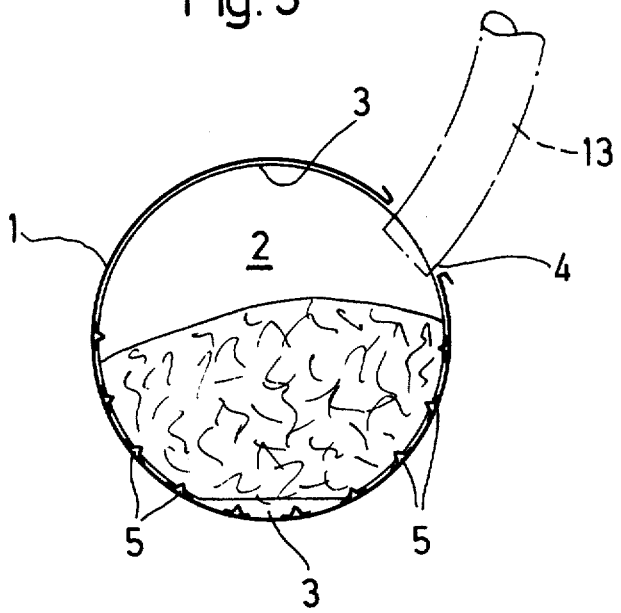
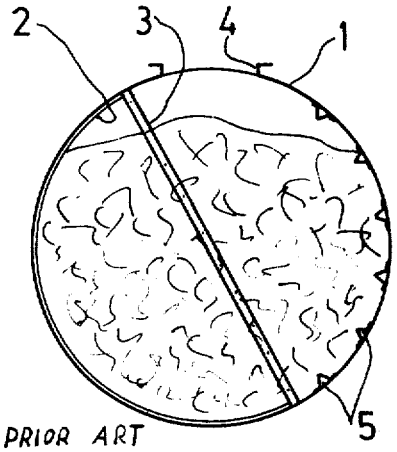
Fig. 3a
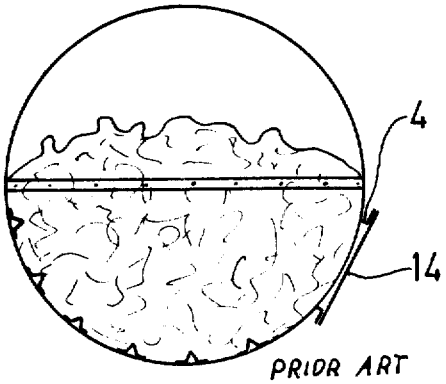
Fig. 3b

DIAPHRAGM PRESS FOR AGRICULTURAL PRODUCTS, SUCH AS GRAPES, FRUITS AND OTHER FRUIT-LIKE PRODUCTS

BACKGROUND OF THE INVENTION

The present invention relates to a new and improved construction of diaphragm press for agricultural products, such as grapes, fruits and other fruit-like products. The diaphragm press of the invention is of the type which comprises a press container which is mounted and driven so as to be rotatable about its horizontal lengthwise axis.

For a long time diaphragm presses have been generally used for pressing-out or squeezing liquid-containing materials or substances. Owing to their simple design and, with respect to the material to be pressed the gentle and protective mode of operation of these diaphragm presses, preferred fields of application thereof have been the pressing-out of laundry and organic materials, such as brewery mash, grapes, fruits and other fruit-like products. The press container, if desired, may be constructed so as to serve at the same time as a rotatable washing container.

In U.S. Pat. No. 2,538,403, granted Jan. 16, 1951, there is disclosed a diaphragm press which is intended to be used especially, but not exclusively, for brewery mash. The press container possesses a substantially longitudinal cylindrical shape and contains a substantially bag-shaped diaphragm. Approximately at the longitudinal central region of the upright container this bag-shaped diaphragm is attached to the jacket or shell of the container and is located in a plane which is perpendicular with respect to the container axis. The diaphragm possesses the advantage that during the extraction or pressing operation it simply needs to be inverted or placed inside out, and thus is not exposed to unfavorable stresses during the pressing process, such as excessive stretching, even when used with unusually large press containers. However, the direct use of this prior art press in winemaking or similar fields is hindered by virtue of the only pivotable mounting of the press container. This is so because winemaking presses are in any case, i.e. even if constructed as piston presses, provided with a rotating or revolving press container, so that between the pressing cycles the mash is loosened and rearranged, and thus, the efficiency of the juice extraction or dejuicing is increased. In this regard, it should be clearly understood that the term "winemaking press" as used herein is employed in the broadest sense and is not intended to be limited to a particular material to be pressed.

The large-scale or increased employment of diaphragm presses in winemaking started about three decades ago. The construction of these diaphragm presses, however, initially was governed by certain aspects which were not necessarily fulfilled by conventional diaphragm presses. In particular, as disclosed in German Pat. No. 1,001,589, efforts were made to enlarge the surface of the diaphragm in proportion to the amount of material to be pressed. Therefore, the diaphragm was given the shape of a hose or tube which was secured to the face ends or sides of the elongated press container which rotated about its horizontal lengthwise axis. This hose-shaped or tubular diaphram had a relatively large diameter compared to the diameter of the press container and together with the jacket or shell of the container formed a correspondingly narrow, substantially ring-shaped press compartment or chamber. It was considered advantageous not only that the diaphragm surface was correspondingly enlarged, but also that the material to be pressed was distributed around the diaphragm in the form of a rather thin layer. The underlying idea was that there thus could be achieved shorter outflow or outlet paths for the juice, and hence, the yield in juice per pressing cycle could be increased. Furthermore, it was assumed that the expansion of the hose or tube would not entail only a radial pressing of the mash, rather that such mash also was displaced in the direction of the periphery of the press container, and thus, there were continually opened up new outflow or outlet paths for the juice.

Presses of this type have proved to be useful. However, it has been found that when rotating the container between the pressing cycles for loosening or slackening the material to be pressed, the diaphragm is thus exposed to mechanical stress and consequently has to be frequently exchanged. It has further been found that the possible increase of the yield in juice by means of the ring-shaped distribution of the material to be pressed around the hose-shaped diaphragm is extensively annihilated by the fact that even with an unloaded diaphragm the press chamber or compartment only occupies an annular fraction of the entire space of the press container and the constantly present pressure chamber, surrounded by the diaphragm, markedly impairs the receiving capacity of the press container. Even if the juice flowed out faster, the press container had to be more frequently emptied and refilled for processing the same amount of pressible material. With any size of the press container this procedure costs more time than could be gained by means of the shorter outflow or outlet paths for the juice.

In order to eliminate these disadvantages there was designed, still for the employment in the winemaking field, a diaphragm press as disclosed in German Pat. No. 2,352,300. The role of the hose-shaped diaphragm was assumed by a diaphragm having a flat or planar surface. Such diaphragm was secured internally of the press container, which rotated about its horizontal axis, in a plane disposed transversely to the axis thereof. In particular, the diaphragm was secured, in the case of a short container, at the region of an end wall thereof and, when using a longer container, approximately at the longitudinal central region of the container. The arrangement was accomplished in this manner in order to avoid overstretching of the diaphragm, since the latter, as opposed to the hose-shaped diaphragm, had to be arched or domed not in a crosswise direction but in the direction of the lengthwise axis of the container. However, with a container wherein the diaphragm was attached at the longitudinal central region thereof, the entire volume of the container could only be used if the diaphragm, which in the unloaded or relieved state had a flat surface, was arched or domed back opposite to the pressing direction during the course of the filling-in of the mash. For this purpose it was necessary to evacuate the pressure compartment. This is a time-consuming and, in addition, expensive process, especially for large volume containers.

To overcome these drawbacks there was initially contemplated a modified design where in an elongate container there is provided a diaphragm not only at one end wall but also at the other end wall of such container, such as has been disclosed in Swiss Pat. No.

226,437. This arrangement was used in conjunction with a diaphragm press of the previously mentioned type, wherein, however, such diaphragm press was used as a laundry press. From the same Swiss Pat. No. 226,437 it becomes evident that the danger of overstretching the diaphragm does not even occur in an elongate container which rotates about its horizontal lengthwise axis, if the diaphragm is not arranged at an end wall but rather such that it bears against the container jacket or shell. Corresponding to the diameter thereof, the maximum deflection of the diaphragm is in any case smaller than if the diaphragm has to be deflected in the direction of the lengthwise container axis, especially if the length of the container amounts to a multiple of the diameter thereof.

These findings also has an influence upon the design of winemaking presses. In fact, the press according to Swiss Pat. No. 579,979, which was especially intended for fruit mash, was equipped with a diaphragm which was secured approximately in the plane of the rotational axis of the container. The diaphragm, which in the unloaded state has a substantially flat surface or bag-shaped configuration, only can be or needs to be domed in crosswise direction. Even with a flat surface of the diaphragm there does not exist any danger of overstretching. If the diaphragm has a substantially bag-shaped configuration, as described above in conjunction with U.S. Pat. No. 2,538,403, such danger does not exist in the first place. However, even with this construction of diaphragm there arises exactly the problem which was intended to be avoided by means of a substantially hose- or tubular-shaped diaphragm. Especially with large capacity containers the outlet paths through the mash to the drainage channels, which are arranged at the wall opposite the diaphragm, are far too long. Moreover, the permeability of the material to be pressed, of course, becomes increasingly smaller as the compaction thereof increases. Just as with the arrangement according to the aforementioned U.S. Pat. No. 2,538,403, the entire space of the press container can be better exploited when using a substantially bag-shaped diaphragm, but the yield in juice is specifically affected thereby.

SUMMARY OF THE INVENTION

Hence, it is a primary object of the present invention to provide a new and improved construction of diaphragm press of the initially mentioned type which is not associated with the aforementioned drawbacks and limitations of the prior art proposals.

Another and more specific object of the present invention is to provide a new and improved construction of diaphragm press, wherein there is avoided the impairment of the efficiency of the juice extraction, something which is particularly important with large capacity containers.

A further important object of the present invention is to provide a new and improved construction of diaphragm press which enables increasing the juice extraction occurring during the pre-dejuicing phase upon filling-in of the mash.

In order to better understand the aforementioned objects of the present invention, reference already is made to FIG. 3*a* of the annexed drawing. Such shows a cross-section of the press as disclosed in Swiss Pat. No. 579,979 although such prior art press is shown provided with a minor, yet essential modification which will be more fully described hereinafter.

With the press as shown in FIG. 3*a* there is arranged in a substantially cylindrical press container 1, which is driven to be rotatable about its horizontal lengthwise axis, a diaphragm or membrane 2 which bears against the inner wall of the container 1. At location 3, in the plane of the rotational axis of the container 1, the diaphragm 2 is provided with a here not further illustrated mounting fixture. The diaphragm 2 is approximately constructed so as to have the shape of one-half of the container 1. As opposed to the embodiment according to the aforementioned Swiss Pat. No. 579,979, with the arrangement according to FIG. 3*a* the inlet and outlet openings are not arranged diametrically opposite the diaphragm 2, but at the immediate neighborhood of the attachment means thereof. This is significant because with the embodiment according to the mentioned Swiss patent the mash initially is filled into the bag-shaped diaphragm, so that in this respect no pre-dejuicing can occur. On the other hand, with the arrangement according to FIG. 3*a*, however, the substantially bag-shaped diaphragm 2 still engages below the inlet or filling opening and also covers the better part of the lower half of the container jacket or shell, but at least a portion thereof remains uncovered by the diaphragm 2. Hence, the juice drainage channels 5 arranged at such uncovered portion of the container jacket come into contact with the mash partially from the beginning and partially gradually with the increasing filling volume of the container, so that during the filling-in of the mash there occurs a limited pre-dejuicing. Therefore, the presses which have become known from Swiss Pat. No. 579,979 in practice were constructed such as illustrated in FIG. 3*a*. Yet, even with this construction it will be apparent that there exists an unfavorable relationship between the filling ratio and the number of juice drainage channels which actively participate in the pre-dejuicing process. The objects of the present invention are predicated upon this state of affairs.

Now in order to implement the foregoing objects and still further objects of the present invention, which will become more readily apparent as the description proceeds, the diaphragm press of the present invention is manifested by the features that there are provided two diaphragms. In the relieved or unloaded state each of these two diaphragms bears against at least a portion of one of the related end walls of the container and against a region of the container jacket which is adjacent to the related end wall. The mounting or attachment of each diaphragm essentially extends in a surface which is inclined or oblique with respect to the container axis and the attachment surfaces of the diaphragms are oriented with opposite inclination towards the respective inlet and/or outlet opening of the container.

With such an arrangement of two diaphragms relative to one another and to the inlet opening, the part of the container wall which is located opposite the inlet opening and the regions adjacent thereto are not covered by the diaphragm. Hence, right from the very beginning the filled-in mash does not fall onto the diaphragm and not even onto the marginal regions thereof, but instead onto the juice drainage channels so that the pre-dejuicing is initiated right from the very beginning. It is here mentioned, the juice drainage channels are perforated chute- or trough-shaped elements or the like. In addition, as opposed to the construction according to FIG. 3*a*, all juice drainage channels come to lie below the mash even with a lower filling ratio of the container, while with the arrangement according to FIG. 3*a* such only occurs after completely filling the container. Moreover, it is to be observed that in the pressing position the container is rotated such that in any case all juice drainage channels are covered by mash. Hence, from the foregoing it follows that the container according to the present invention can practically be left in the filling position for performing the pressing operation, since even in this position there is achieved a complete covering of all juice drainage channels.

BRIEF DESCRIPTION OF THE DRAWINGS

The invention will be better understood and objects other than those set forth above will become apparent when consideration is given to the following detailed description thereof. Such description makes reference to the annexed drawings, which schematically illustrate further details of the present invention and wherein:

FIGS. 1 and 2 respectively illustrate in longitudinal sectional view and top plan view a press constructed according to the present invention;

FIG. 3 is a cross-sectional view of the longitudinal central region of the press container depicted in FIGS. 1 and 2;

FIG. 3*a* is a cross-sectional view of a press container essentially corresponding to Swiss Pat. No. 579,979 and shown in the filling position;

FIG. 3*b* equally is a cross-sectional view of the press container according to FIG. 3*a*, but shown in the pressing position.

DETAILED DESCRIPTION OF THE PREFERRED EMBODIMENTS

Figure 4:
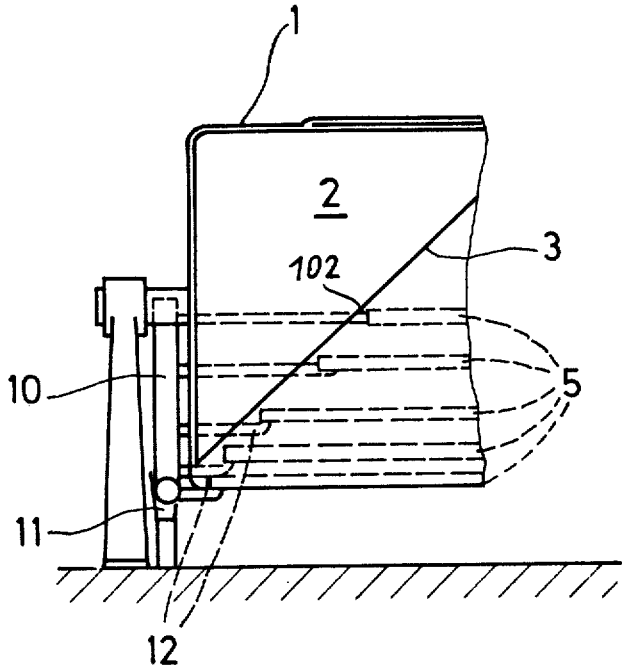
FIG. 4 is an end section of the press according to FIG. 1 provided with a modified detail.

Describing now the drawings, according to FIG. 1 the press container 1 is essentially horizontally mounted in a frame or the like, generally designated by reference numeral 6, so as to be rotatable about its horizontal axis and can be rotationally driven by the schematically shown drive 100 for certain operating phases. Arranged in the press container 1 are two diaphragms or membranes 2 or equivalent structure which, with respect to the container lengthwise axis, are positioned at an inclination and oriented with their diaphragm attachment surfaces 2*a* at an opposite or opposed inclination towards the product throughpass opening 4, here the inlet and outlet opening 4. Each of the two diaphragms 2 practically covers the related end wall 1*a* of the container 1 and bears against a region of the container jacket or shell 1*b* which neighbors the related end wall 1*a*. These diaphragms 2 also could be compared to the structure which would result, for instance with respect to the initially described U.S. Pat. No. 2,538,403, if there were mounted at each end of the container interior a substantially bag-shaped diaphragm which bears against the related end wall thereof, by removing a portion of each such diaphragm by means of a diagonal or inclined cut. Thus, the diaphragms are not mounted in a plane which is perpendicular with respect to the lengthwise axis of the container, rather in a plane which is inclined with respect to such lengthwise axis. In the narrower sense of the word, such diaphragms could be described as being hood-shaped and are comparable to the head protection worn by women in earlier days, or to the erected collapsible weather-protective covering or hood of horse-drawn carriages.

With this shape of the diaphragm 2 it is irrelevant that the related end wall 1*a* is entirely covered by the diaphragm. Thus, with the illustrated exemplary embodiment a segment or portion of the end wall 1*a* remains free, as indicated by the course of the diaphragm attachment means generally indicated at location 31. This free segment or portion serves for guiding the juice drainage channels 5 correspondingly arranged thereat through such end wall 1*a*. It is equally irrelevant if the attachment means 3 for the diaphragms 2 are located in a flat or planar surface. In fact, the diaphragm attachment means 3 could define a spatially curved surface. Furthermore, it is unimportant that the diaphragm attachment means 3, as shown at location 32, are provided with two adjoining apexes or crowns, and the inlet and outlet opening 4 is arranged in the angle between the diaphragm attachment means 3. In fact, the opening 4 could be arranged between the apexes 32 of the diaphragm attachment means 3 and then preferably possess a rather elongate shape which extends in the peripheral or circumferential direction. Of course, even with the illustrated arrangement the opening 4 need not have an exactly circular configuration. In addition, it is unimportant that the diaphragm attachment means 3 are arranged in symmetrical relationship to one another or to the opening 4. In fact, it is easy to conceive constructions wherein the opening 4 is not located in the longitudinal central region of the container 1.

In FIG. 1 the pressure compartment 7 located behind the diaphragms 2 is only generally indicated, since the diaphragms 2 bear against the end walls 1*a* and the container wall or jacket wall 1*b*. This pressure compartment 7 can be selectively connected to a suitable source of pressurised air or to a negative pressure source by means of a conduit or line 8 which, at location 81, is guided through the one bearing means 9. At location 82 the conduit or line 8 is connected to the pressure compartments 7 located behind the diaphragms 2. Of course, the pressurized fluid medium also arrives at the portion of the pressure compartment 7 which is located between the related end wall 1*a* of the container 1 and the portion of the diaphragm which faces the same. Thus, the diaphragms 2 also dome or arch in axial direction.

As illustrated in FIG. 1, the drainage channels 5 can be guided through the portion of the container end wall 1*a* which remains free, but moreover, however, through the diaphragm attachment means and can terminate externally of the container 1 in a substantially ring-shaped collecting pipe or tube 10 or equivalent structure. From this location the juice arrives in conventional manner at a catch or collecting trough 11 or the like. However, as can best be seen by referring to the modified embodiment of FIG. 4, it is possible to connect the juice drainage channels 5 with the collecting pipe or tube 10 by means of pipe studs or connections 12 or similar structure. These pipe studs 12 extend externally of the container jacket or shell 1*b* and are connected to the drainage channels 5 by means of suitable openings, generally indicated by reference character 102, provided in the container jacket or shell 1*b*.

During the filling of the container 1 the same is located in the position illustrated in FIGS. 1 and 3, wherein the filling material is guided through a flexible hose 13 or the like into the container 1, hose 13 engaging into the opening 4. From the outset, the filling material falls onto the juice drainage channels 5, as will be easily recognized by referring to FIGS. 1 and 3. These juice drainage channels 5 are located without exception in the lower half of the container 1, so that at a relatively small filling ratio of the container they are covered with mash. Thus, the yield in juice by pre-dejuicing is considerably increased.

It should be remarked that the filling position shown in FIG. 3 is ideal for carrying out the pressing operation or process, since all juice drainage elements are located in an optimum position. This also holds true with respect to the position of the diaphragms 2 which extend over the material to be pressed. In order to attain the same result the prior art presses had to be displaced from the filling position according to FIG. 3*a* into the filling position as shown in FIG. 3*b*. Of course, the inlet opening 4 and the lid or cover 14 closing the same thus arrived at a position below the material to be pressed. Consequently, the locking arrangement of the lid or cover 14, which mostly was formed by guides, and the seal of such lid or cover 14, were directly exposed to the pressing pressure. However, owing to the above-described attachment of the diaphragms the inlet opening 4 during the pressing is located, as clearly seen by referring to FIG. 3, above the material to be pressed. Thus, the lid closure and the guides of the, as a rule, displaceable lid or cover are subject to a considerably smaller amount of mechanical stress. In addition, a possibly prevailing limited tightness of the lid or cover is not associated with any serious consequences.

The arrangement under discussion apparently is afflicted with the disadvantage that the container 1 only can be filled up to the lower rim of the inlet opening 4. However, if the container 1 is to be completely filled, it only is necessary to turn or rotate it by a small angular degree, so that the container opening 4 now comes to lie at the upper side thereof. Hence, the juice drainage channels or paths 5 are freed and there is ensured for a pre-dejuicing with short drainage paths of the last loaded amount of filling material. After closing the fill opening 4 the container 1 again can be rotated back into the position depicted in FIG. 1. Even this to-and-fro container movement, which necessarily is carried out at low speed, requires less time than was needed with the prior art constructions according to FIGS. 3*a* and 3*b*.

As has previously been described, during the pressing process the diaphragms not only dome or arch in crosswise direction but also in the lengthwise direction of the container and in the diagonal direction, respectively. Thus, in addition to the radial component a considerable axial component is produced. This accounts for displacements and rearrangements of the material to be pressed, and always new drainage paths are opened up. Moreover, the press cake is given a different shape than if the mash only was compressed in radial direction. When breaking-up the press cake, which is performed in conventional manner by turning the container after previously bringing the diaphragms to bear against the jacket and the end walls of the container, the same cannot only be rolled around or agitated but also moved back-and-forth in lengthwise direction. In this regard a role is played by the diaphragm attachment means which are forwardly arranged with respect to the sense of rotation. This role consists in effecting an axially directed conveyor or feed action, as such is known from conveyor or feed worms. This is particularly important when, after finishing the last pressing cycle, the grape or product residue has to be removed. In this instance, the diaphragm attachment means assume the function of removal or ejection elements. For this purpose, they can have a corresponding configuration suitable for this purpose, such as being higher in size than otherwise required if their function was merely as attachment means for the diaphragms.

In summation, it may be remarked that there arise essential advantages from the increased pre-dejuicing, the special manner of pressing the processed products, the intensified slackening or loosening of the press cake, and finally, from the removal of the remaining grape or product residue. All in all, this leads to a general shortening of the press cycles, while ensuring for a protective juice extraction. Further worthy of mention is the possibility of being able to visually observe the internal space or compartment of the container during the filling process, by virtue of the then sideways inclined position of the inlet opening. As a modification from illustrated exemplary embodiments, the pressure compartments 7 also can be individually connected to the pressurized air source or the negative pressure source, respectively. Consequently, the press space could be reduced for processing smaller loads or batches of material, and it would no longer be necessary to always fill the entire volume of the two pressure compartments with air or to evacuate the same, respectively.

While there are shown and described preferred embodiments of the present invention, it is to be distinctly understood that the invention is not limited thereto but may be embodied and practiced within the scope of the following claims.

What I claim is:

1. A diaphragm press for agricultural products, especially grapes, fruits and fruit-like products, comprising:
   - a press container having opposed end walls and intermediate thereof a container jacket and a substantially horizontal lengthwise axis;
   - means mounting said press container for rotation about said lengthwise axis;
   - means for driving said container to be rotatable about said lengthwise axis;
   - two diaphragms provided internally of said press container;
   - each of said diaphragms, in an unloaded state thereof, bearing against a portion of a related one of the end walls of the container and against a region of the container jacket neighboring the related one of said end walls;
   - said container being provided with means defining a product throughpass opening;
   - attachment means provided for each of said two diaphragms for mounting same within said press container;
   - said attachment means for each diaphragm extending essentially in a plane positioned at an inclination with respect to the lengthwise axis of the press container;
   - each of said diaphragms having attachment surfaces; and
   - said attachment surfaces of said two diaphragms extending in opposite inclination towards said product throughpass opening.

2. The diaphragm press as defined in claim 1, wherein:
   - said product throughpass opening defines an inlet and outlet opening for the product being processed.

3. The diaphragm press as defined in claim 1, wherein:
   - said attachment means define mutually neighboring apex regions; and said product throughpass opening being arranged at a region located within an angle formed by said apex regions.

4. The diaphragm press as defined in claim 3, wherein:

said product throughflow opening extends through an area located between said apex regions.

5. The diaphragm press as defined in claim 1, wherein:

said diaphragm attachment means are structured as removal elements serving for the removal of product residues.

6. The diaphragm press as defined in claim 1, further including:

pressure compartments located behind said diaphragms; and said pressure compartments being individually selectively connectable to a pressurized air source or to a suction air source.

7. The diaphragm press as defined in claim 5, further including:

pressure compartments located behind said diaphragms; and said pressure compartments being individually selectively connectable to a pressurized air source or to a suction air source.

* * * * *